US006206425B1

(12) United States Patent
Heyer

(10) Patent No.: US 6,206,425 B1
(45) Date of Patent: Mar. 27, 2001

(54) FILING FOLDER, IN PARTICULAR FOR LATERAL FILES

(75) Inventor: Hans Egon Heyer, Wuppertal (DE)

(73) Assignee: Mappei-Organisationsmittel GmbH, Wuppertal (DE)

( * ) Notice: Subject to any disclaimer, the term of this patent is extended or adjusted under 35 U.S.C. 154(b) by 0 days.

(21) Appl. No.: 09/355,511

(22) PCT Filed: Oct. 5, 1998

(86) PCT No.: PCT/EP98/06316

§ 371 Date: Jul. 28, 1999

§ 102(e) Date: Jul. 28, 1999

(87) PCT Pub. No.: WO99/29515

PCT Pub. Date: Jun. 17, 1999

(30) Foreign Application Priority Data

Dec. 5, 1997 (DE) ..... 297 21 471 U

(51) Int. Cl.[7] ..... B42D 15/00
(52) U.S. Cl. ..... 281/29; 281/45; 40/359
(58) Field of Search ..... 281/29, 31, 37, 281/45, 51; 283/36–42; 40/359

(56) References Cited

U.S. PATENT DOCUMENTS 3,933,294 * 1/1976 Meenan et al. ..... 40/359
3,937,493 2/1976 Fasbender .
4,715,621 * 12/1987 Colavito et al. ..... 283/36
5,639,124 * 6/1997 Jung ..... 283/36
5,641,182 * 6/1997 Schwandt ..... 283/36
5,890,774 * 4/1999 Schwartz et al. ..... 281/31
5,906,397 * 5/1999 MacWilliams et al. ..... 283/36

FOREIGN PATENT DOCUMENTS 3504792 8/1986 (DE) .
0129713 1/1985 (EP) .

* cited by examiner

*Primary Examiner*—Willmon Fridie, Jr.
(74) *Attorney, Agent, or Firm*—Martin A. Farber

(57) ABSTRACT

A file folder (A), in particular for lateral files, comprising a front wall (1) and rear wall (2) which can be folded against one another about a fold line (3). On its border edge (4), which runs perpendicular to the fold line (3), one of the two walls has a text tab (F) which projects beyond the border edge (4) of the other wall, the tab comprising two strips (a, b) which are located congruently one above the other, and, in order to achieve a configuration which is advantageous in terms of use, the two strips (a, b) can be folded out of their position in which they are located congruently one above the other (FIG. 4) into a position in which they are located on a level one beside the other (FIG. 3) on the inside of the wall, and the two strips (a, b) are fixed on the inside of the wall both in the position in which they are located congruently one above the other and in their position in which they are located one beside the other.

13 Claims, 8 Drawing Sheets

A
1
2
3
4
5
6
7
10
13
a
b
F
F'

FILING FOLDER, IN PARTICULAR FOR LATERAL FILES

FIELD AND BACKGROUND OF THE INVENTION

The invention relates to a file folder, in particular for lateral files, comprising a front wall and a rear wall which can be folded against one another about a fold line, it being the case that on its border edge which runs perpendicular to the fold line one of the two walls has a text tab which projects beyond the border edge of the other wall, the tab comprising two strips which are located congruently one above the other.

From U.S. Pat. No. 3,937,493, there is known a file folder in which a tab which projects beyond the other border edge functions as a carrier for riders which can be adhesively associated therewith. Moreover, the tab-free wall is also cut back somewhat with respect to the basic format, with the result that the wall which in this case serves as front wall has a smaller surface area. Moreover, the tab also continues into a head tab.

A file folder in which the text tab is formed from two strips which are located congruently one above the other is commercially available. For this purpose, a [lacuna] which is provided for in the folding blank is folded in in the region of the border edge which is to be formed and is adhesively bonded to that region of the inside of the front wall and also of the rear wall which is in the vicinity of the border. This leads to a doubling of the number of layers in this region. In the case of a narrow stack or row of files, this results in a raised section which disrupts the parallelism of the fine folders.

SUMMARY OF THE INVENTION

It is an object of the invention to configure a file of this type by straightforward means such that it is more advantageous in terms of use.

This object is achieved first and foremost in the case of a file folder wherein the two strips can be folded out of their position in which they are located congruently one above the other into a position in which they are located on a level one beside the other to the wall, and the two strips are fixed to the wall both in the position in which they are located congruently one above the other and in the position in which they are located one beside the other. This means that, together with the front wall and rear wall, it is not necessarily possible to go beyond three layers. By folding the strips out to the maximum extent in order to achieve the largest possible text tab, even this three layer arrangement is not exceeded; the double-layered arrangement of this text tab is located outside the basic contour of the file folder. When not in use, the strips are located one beside the other. If the file folder is intended to have a marking function, the positioning of the strips one above the other is effected. In both cases, fixing takes place on the inside of the relevant wall. The setting up of such a file folder is easier in that there is connected to the free border edge of one of the strips a grip flap which rests flat on the inside of the wall in both positions of the strips. Taking account of the possibility of selection, it has proven favourable, then, for the fixing to be achieved by adhesion. Such a reversible arrangement makes it possible for the file folder at any time to be changed over again or transformed into the original state, i.e. for the strips to be brought into the position in which they are located one beside the other and for the grip flap to be allowed to disappear in a protective manner in the interior of the file folder. In specific terms, the adhesion is such that it is formed by a self-adhesive layer which comes into engagement in each case against a non-stick mating layer. An adhesion counterpart is thus associated with each of the basic positions which can be achieved. Alternatively, however, another solution which is advantageous in terms of use is one in which the fixing is achieved by push-in flap insertion, preferably of the push-in flap. Accordingly, the design is such that the push-in flap of the grip tab terminates in two push-in slits of the wall, which are associated with the positions. Corresponding storage positioning does not require the text tab including the grip tab to be folded in to the full extent since it is not yet subject to the demands of use. It is only in the two positions that such anchoring is expedient or welcome. Finally, there is a further extended stage for a text tab, with formation of a position in which the strips are located one beside the other substantially outside the contour of the wall. In this case, the rear side of the grip flap is used advantageously for fixing purposes, the self-adhesive section being used here as well and the uncoated border strip of the grip flap being covered over the full surface area. The border strip is always underlapped.

BRIEF DESCRIPTION OF THE DRAWINGS

The subject matter of the invention is explained in more detail hereinbelow with reference to an exemplary embodiment illustrated in the drawings, in which FIG. 7 shows the front view of the file folder, the position according to FIG. 5.

DETAILED DESCRIPTION OF THE PREFERRED EMBODIMENTS

Figures 1, 2, 3, 4, 5:
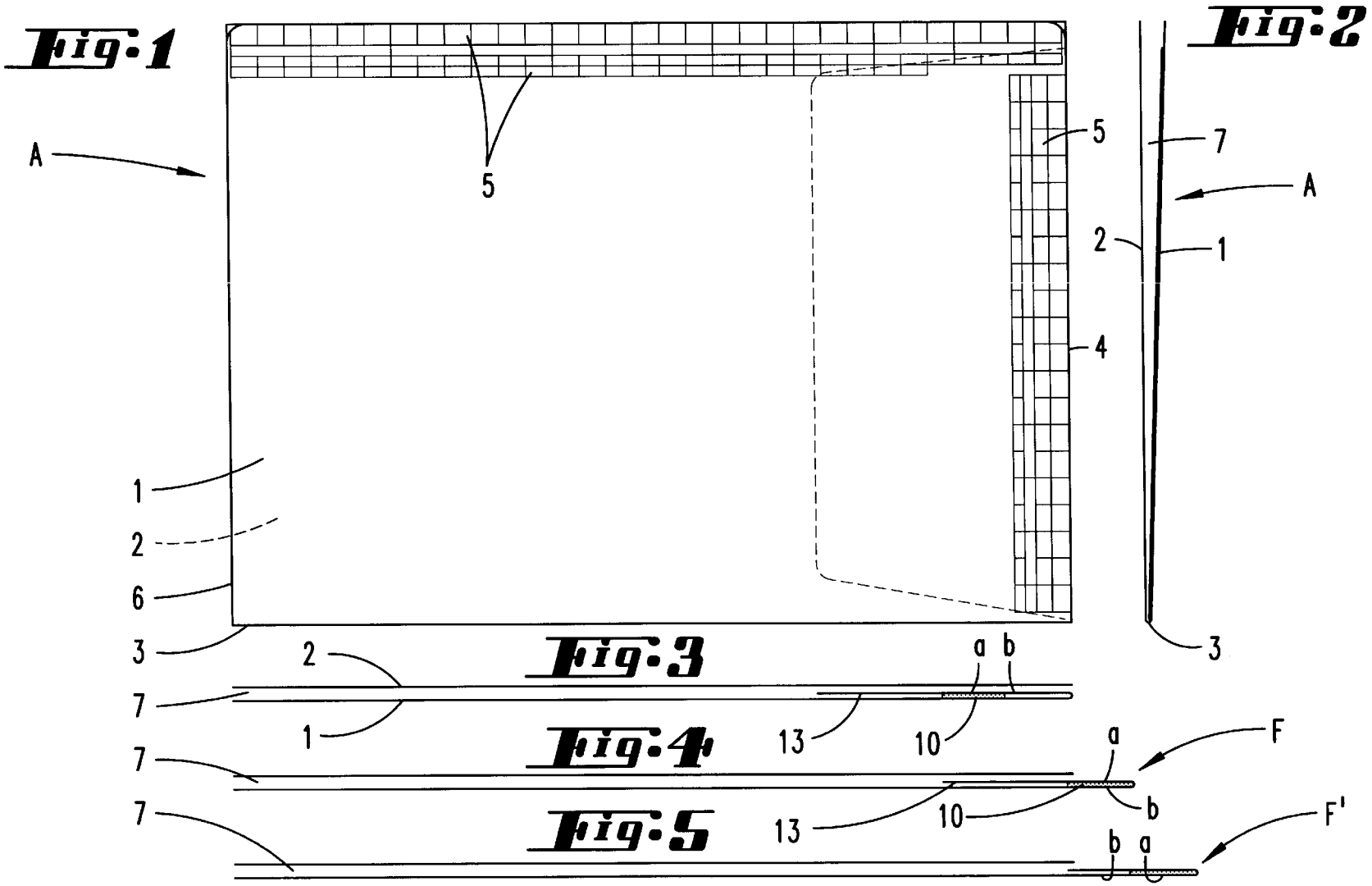
FIG. 1 shows the file folder according to the invention in front view.
FIG. 2 shows a side view.
FIG. 3 shows the plan view of that narrow side of the file folder which is remote from the fold line, with strips located one beside the other in the inside.
FIG. 4 shows an illustration corresponding to FIG. 3, with the strips located one above the other.
FIG. 5 shows the strips located one beside the other the outside, this achieving an enlarged text tab.

The file folder A, which is designed in particular for lateral files, has a front wall 1 and a rear wall 2. The corresponding folding blank provides a fold line 3 on one longitudinal side. The fold line is also provided for in the production of the folding blank of the file folder A, which is formed from paperboard/paper material.

Front wall 1 and rear wall 2 are substantially of the same surface area. The front wall 1 has scales 5 printed on in the vicinity of its top longitudinal edge and of a right-hand border edge 4. The scale graduations contain letters in alphabetical order and numerically ascending scale rows (including Roman numerals as well as Arabic numerals). This provides a good organizational overview and gives the basis for quickly identifiable marking.

It would also be possible for the left-hand border edge 6 to be equipped correspondingly.

Both the right-hand border edge 4 and the left-hand border edge 6 extend perpendicular to the fold line 3.

The file folder A has a text tab F which can be extended out of the fold gap 7 between front wall 1 and rear wall 2. The text tab is realized as an addition to the folding-blank addition which is connected to the right-hand border edge 4 by a fold line. This first border-parallel fold line bears the reference mark 8.

Figure 6:
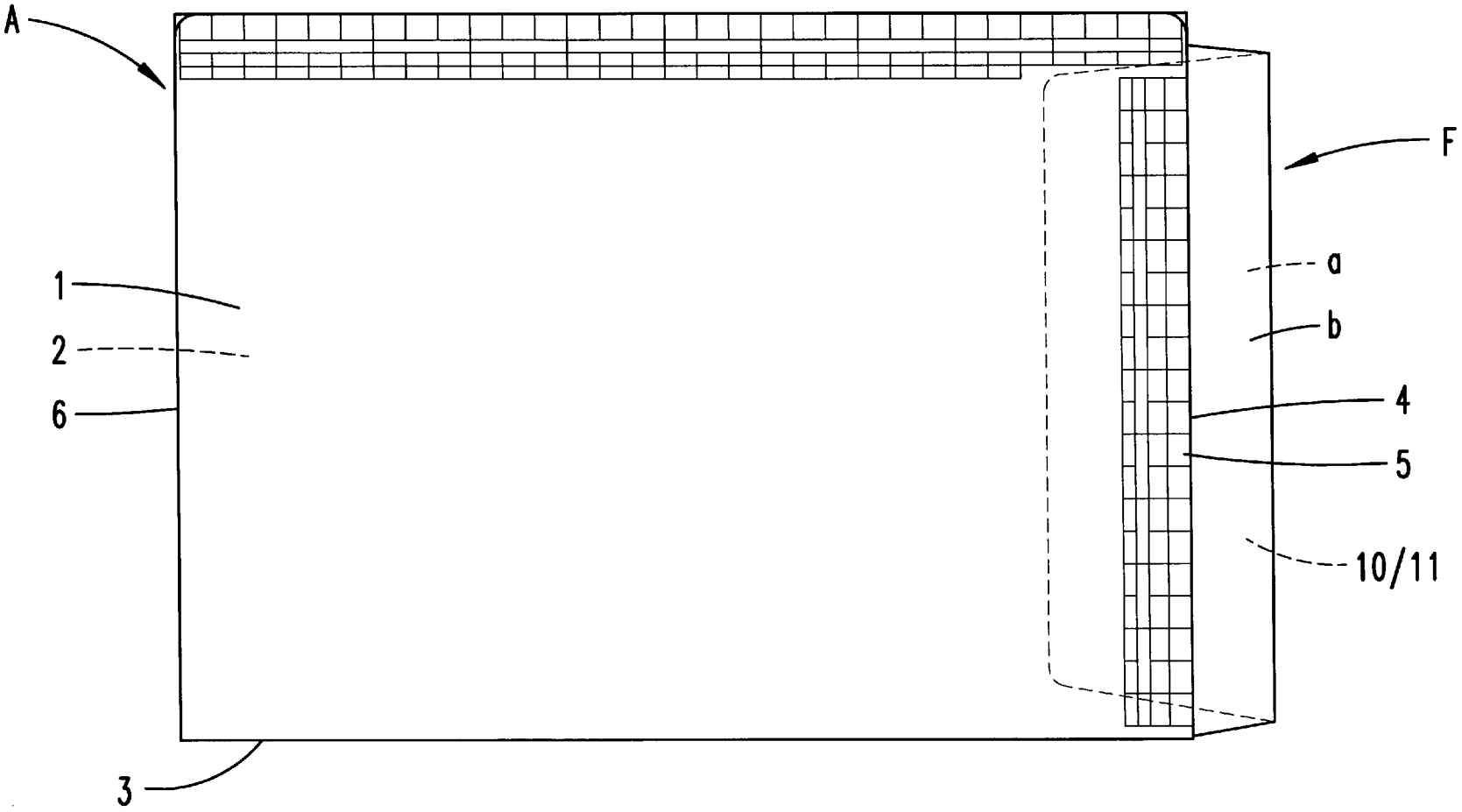
FIG. 6 shows the front view of the file folder, the position according to FIG. 4 being illustrated.
Figure 1:
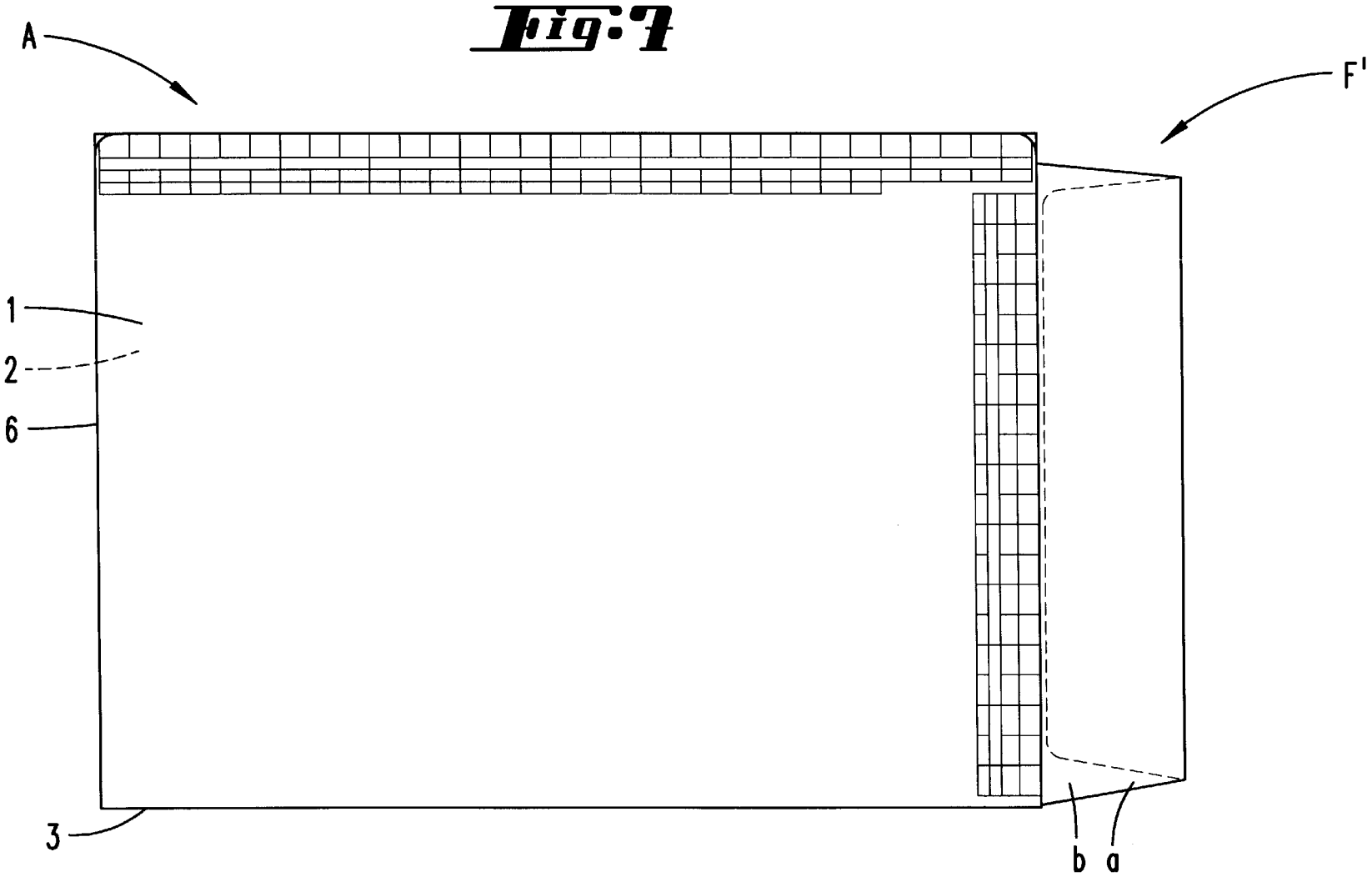
Figure 8:
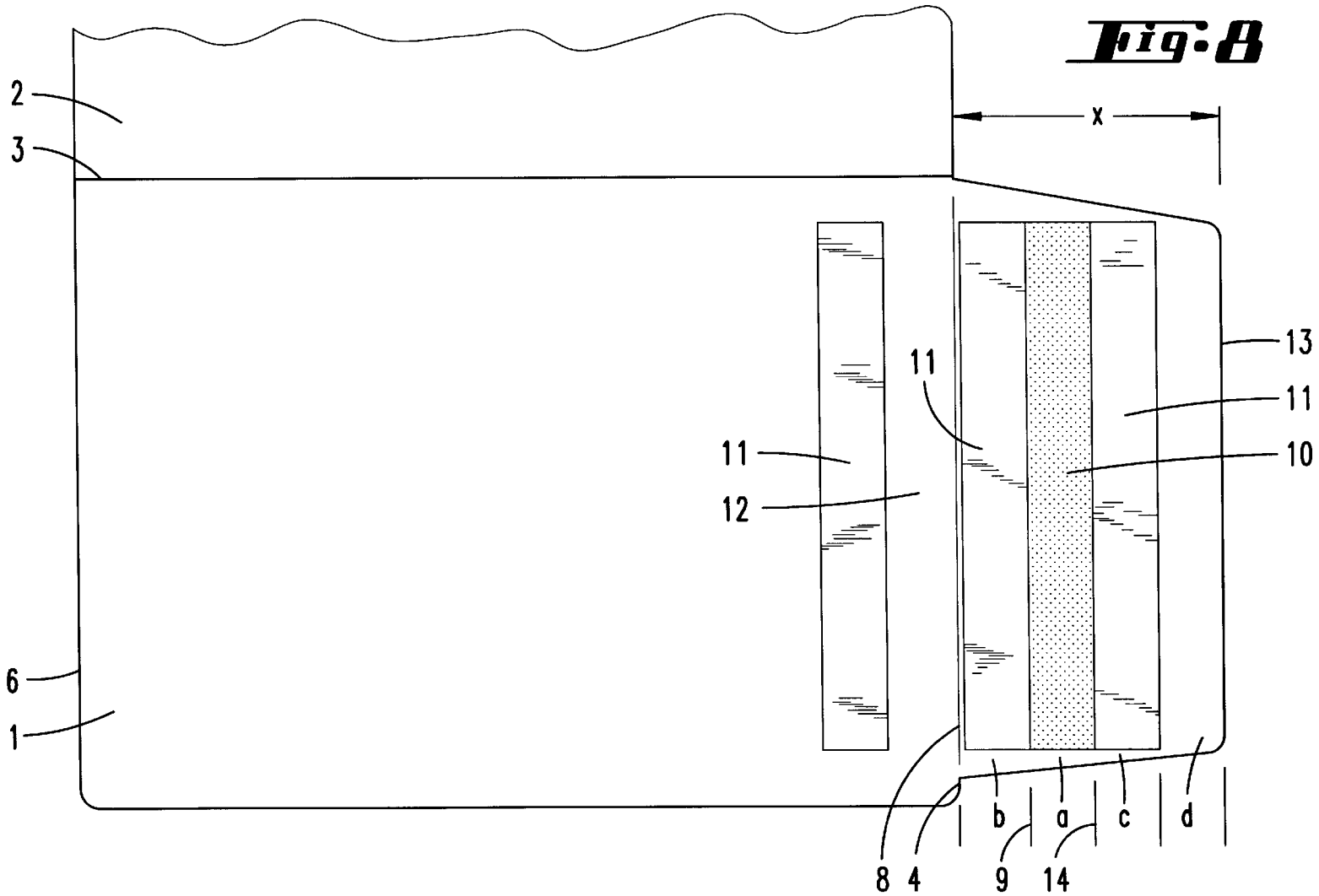
FIG. 8 shows the file folder in the folded-open state, illustrating the blank (partially broken-away)
Figure 10:
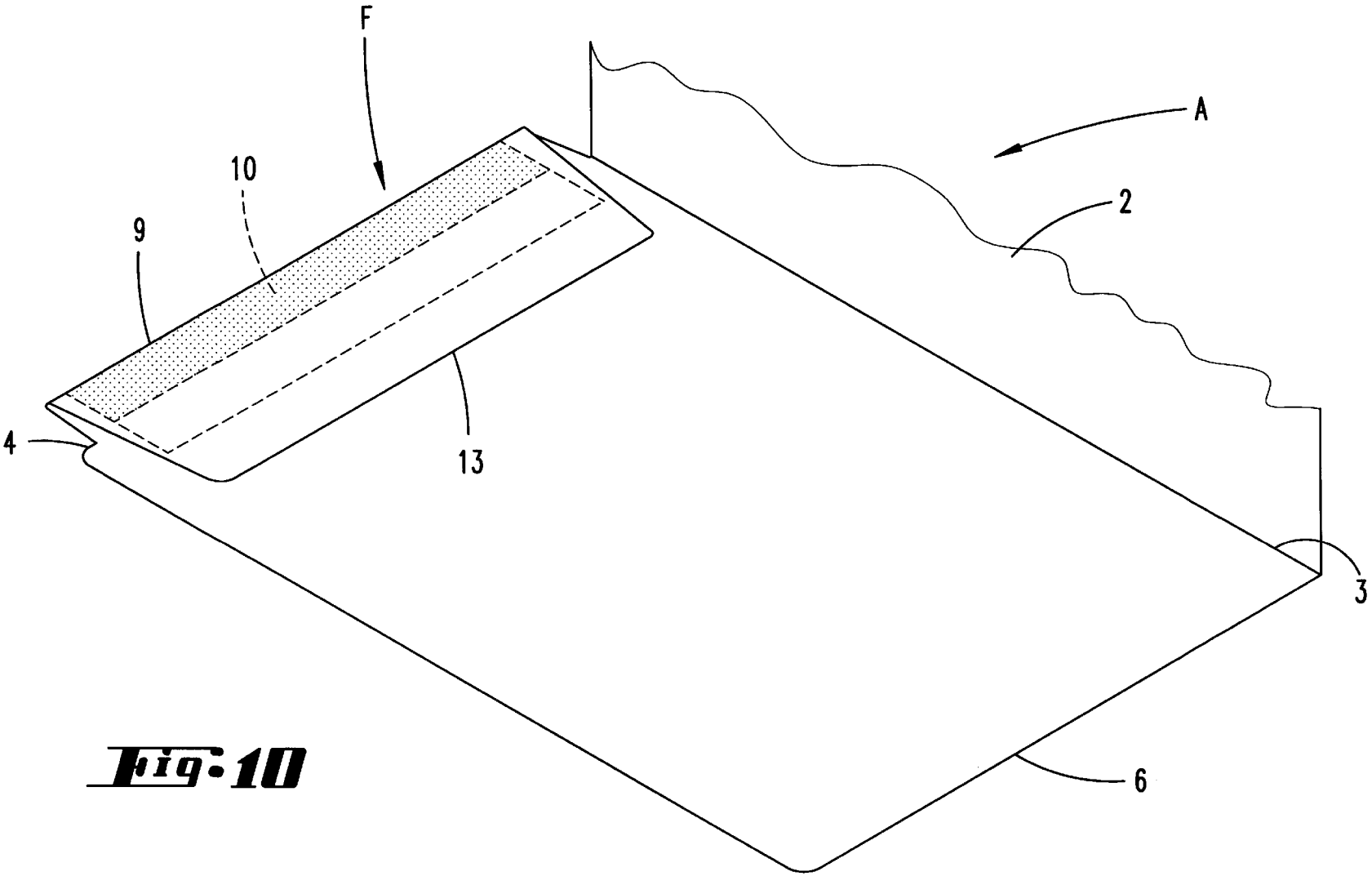
FIG. 10 shows an illustration corresponding to FIG. 9, illustrating the situation of FIG. 4.

As seen over the width x (FIG. 8), the folding-blank addition is of such an overall dimension that at least two strips a, b are provided for in this dimension. These strips can be brought into a position in which they are located congruently one above the other. When located congruently one above the other, they assume the position according to FIGS. 4, 6 and 10. They thus form a free-standing text tab F which projects beyond the right-hand border edge 4 of the file folder A. The text tab extends more or less over the entire length of the border edge 4.

The two congruently configured, each approximately fingertip-width strips a, b are in defined folding-action connection with one another by way of a second fold line 9.

Figure 9:
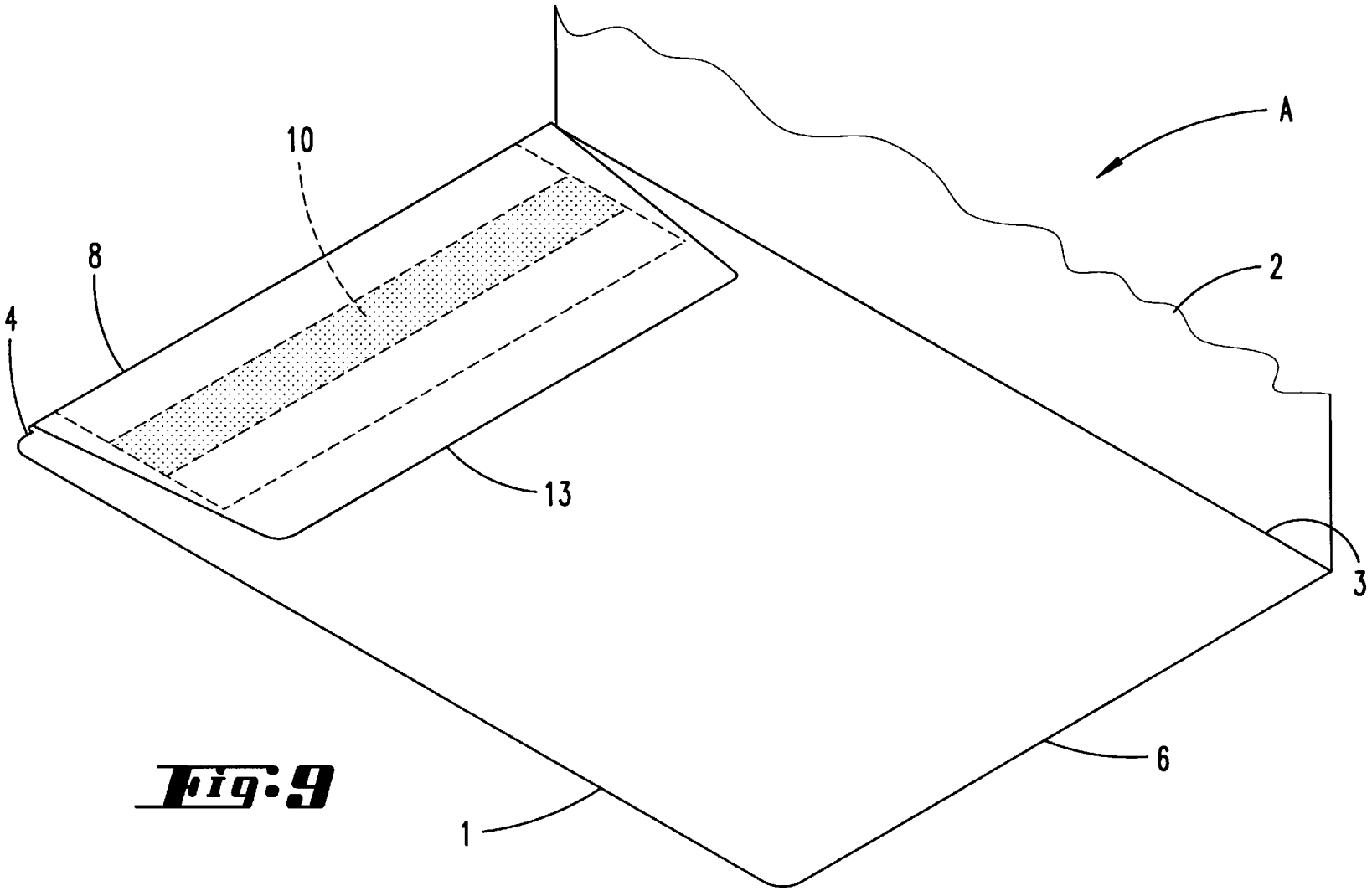
FIG. 9 shows, in a perspective illustration, a view into the folded-open file folder, illustrating the situation according to FIG. 3.

In the basic position, the two strips a, b assume a position in which they are located one beside the other within the fold space 7 (see FIGS. 1, 3 and 9). In this case, they are in a position in which they are located on a level one beside the other on the inside of the front wall 1 since, according to a preferred exemplary embodiment, the folding-blank addition, for forming the text tab F, extends from this wall. Despite the presence of two strips a, b, the file folder A has here in total three layers.

In order to return the file folder out of the position prevailing in FIGS. 4 and following into the position illustrated in FIGS. 1 and following, it is made possible, as can be seen, for the two strips a, b to be foldable out of their position in which they are located congruently one above the other (FIG. 4) into the position in which they are located on a level one beside the other (FIG. 3) on the inside of the wall.

In order to secure the respective position, the two strips a, b are fixed on the inside of the wall both in the position in which they are located congruently one above the other (FIG. 4) and in their position in which they are located one beside the other (FIG. 3).

The fixing is realized by adhesion.

The adhesion is provided by a self-adhesive layer 10. This is illustrated in the drawings as a pattern of dots.

In order to achieve reversible fixing, in each of the two positions, a non-stick mating layer 11 is associated with the self-adhesive layer, against which layer 11 the self-adhesive layer 10 is forced to come into engagement, with the same contour, by way of the fold lines 8, 9.

The non-stick mating layer 11 for securing the basic position is located on the inside of the front wall 1, whereas the non-stick mating layer 11 for the position which forms the text tab F is seated on the folding-blank addition itself. An untreated, strip-size intermediate space 12 remains between the two mating layers 11. Material is saved by this, which is not insignificant in the case of mass-produced articles. In regard to the mating layer 11, a silicone layer may be in question.

A grip flap 13 is connected to the normally free border edge of one a of the strips, which is on the right-hand side in the drawing. The connection in question is effected by a third fold line 14.

The grip flap 13 forms more or less, or slightly less than, half of the width x of the folding-blank addition.

Figure 11:
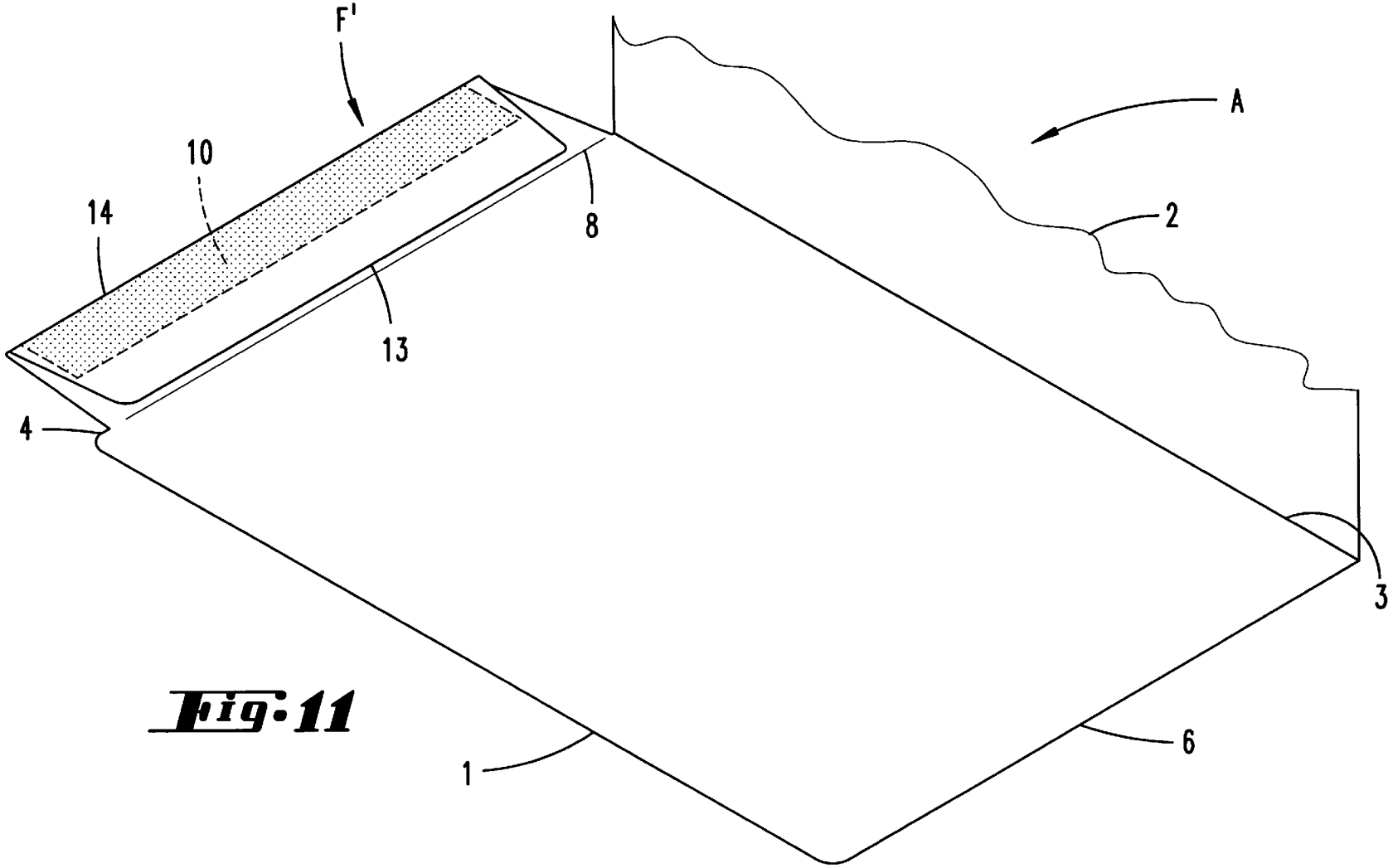
FIG. 11 shows an illustration corresponding to FIG. 9, embodying the situation according to FIG. 5.

A folding movement of the grip flap 13 by way of the said fold line 14 results in a text tab F' of approximately double the width of the text tab F, which can be seen from FIG. 4. Strips are also located one above the other in this position, but in this case they are located substantially outside the fold space 7. Reference is made to FIGS. 5, 7 and 11. Fixing is also possible in the position with a wider text tab F', to be precise in this case using the self-adhesive layer 10 to which a non-stick mating layer 11 is connected on the right-hand side in FIG. 8. This is likewise provided in the form of a strip c. Another strip d is connected at the right-hand periphery of the strip c. The size of the strip d also corresponds to that of a strip a or b or c. The rear side of the strips c and d provides full-surface area covering and a securing or text zone in relation to the self-adhesive layer 10 and left-hand mating layer 11, covered by the strips c and d.

The fold lines 8, 9 and 14 all run parallel to the relevant border edge 4.

Figure 12:
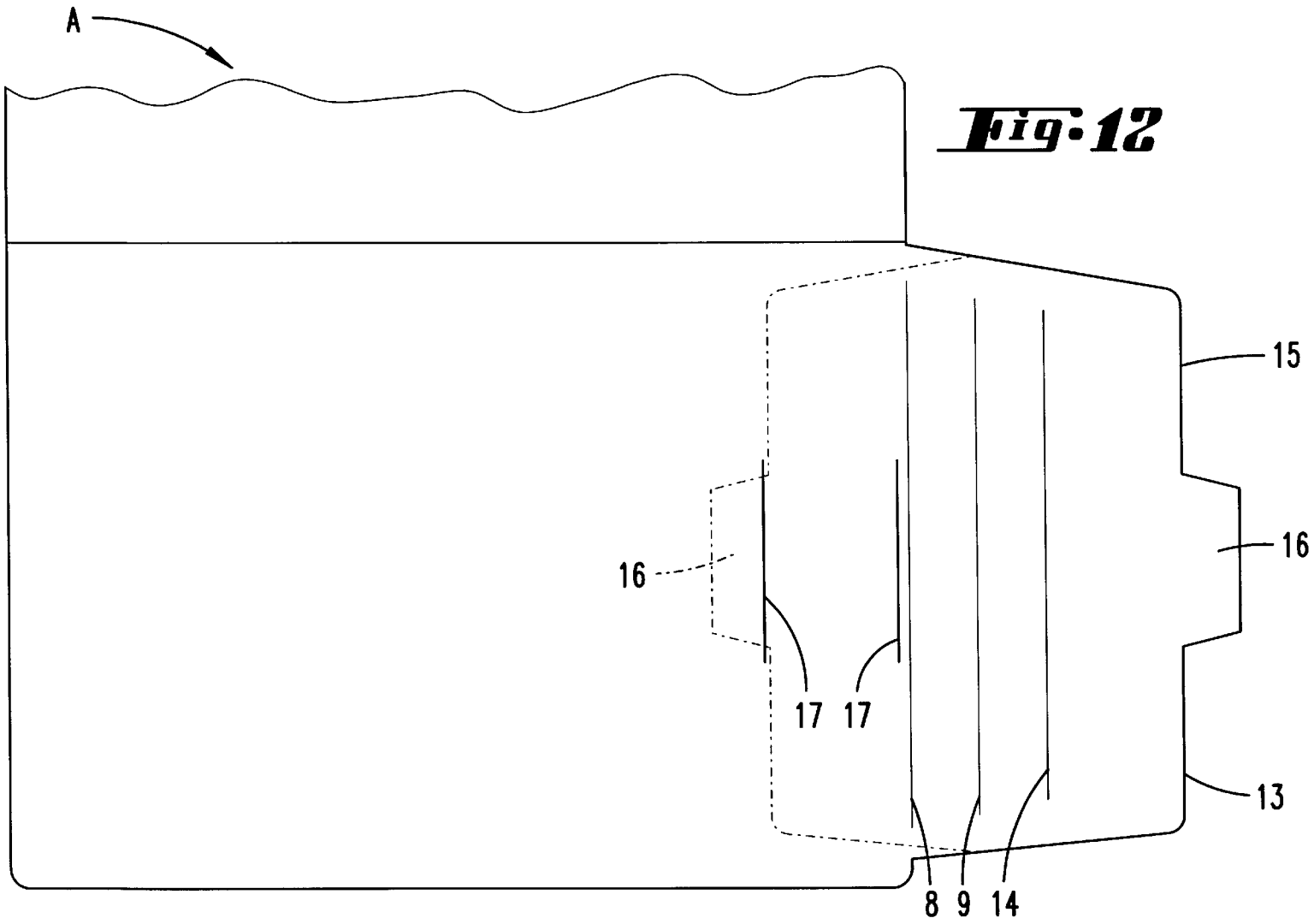
FIG. 12 shows a modified embodiment of the file folder in an illustration like that of FIG. 8.

With the same fold-line arrangement, the additional section, or in other words folding-blank addition, which forms the text tab F or F', is also used for adhesive-free fixing of the respective positions. For this purpose, use is made of a push-in flap 16 which extends from the outer border edge 15 of the grip flap 13. The corresponding push-in flap insertion can be gathered from FIG. 12. Such a push-in flap 16 is also provided for during punching of the blank, this, as well as the associated push-in slits 17, being located entirely within the contour of the front wall 1.

Of course, it is possible for the text tab F to be formed on the rear wall 2 of the file folder.

What is claimed is:

1. File folder (A) for lateral files, comprising a front wall (1) and rear wall (2) which are foldable against one another about a central fold line (3), wherein on a border edge (4), which border edge runs perpendicular to said central fold line (3), one of said walls has a text tab (F) formed in one-piece with said one wall and which projects beyond a corresponding border edge (4) of the other of said walls in a first folded position of said tab, the tab comprising two strips (a, b) which two strips are located congruently one above the other in said first folded position of said tab, wherein the two strips (a, b) are foldable out of said first folded position into a second folded position (FIG. 3) in which second folded position said two strips are located in one common level one next to the other on an inside of the one wall, and wherein the two strips (a, b) are fixed adjacent to and on the inside of said one wall in both the first folded position in which said two strips are located congruently one above the other and in the second folded position in which said two strips are located in said one common level one next to the other, respectively.

2. File folder according to claim 1 wherein said tab includes a grip flap (13) connected to a free border edge of one (a) of the strips, the flap resting flat in said one common level on the inside of the one wall in both said first and second folded positions.

3. File folder according to claim 1, wherein said strips are fixed by adhesion.

4. File folder according to claim 3 the adhesion is achieved by a self-adhesive layer (10) which comes into engagement in each said first and second folded positions, respectively, against a non-stick mating layer (11).

5. File folder according to claim 2, wherein said strips are fixed by a push-in flap insertion (16/17) of the grip flap (13).

6. File folder according to claim 5, wherein said grip flap at a free end has a push-in flap (16) of the grip flap (13) and in said push-in flap insertion said push-in flap terminates in two push-in slits (17) in said one wall, which slits respectively are associated with the first and second folded positions.

7. File folder according to claim 1, wherein said tab further comprises a third strip adjacent one of said two strips wherein said tab is foldable into a further extended position of said text tab, with formation of a third folded position of said tab wherein said two strips (a, b) are located next to each other co-planar with said one wall of said file folder in a common plane of said tab substantially beyond said border edge of the other of said walls and substantially outside the contour of the one wall and wherein said third strip lies congruently above said adjacent one of said two strips in said third folded position of said tab.

8. File folder according to claim 1, wherein said strips are fixed by a push-in flap insertion (16/17).

9. File folder according to claim 8, wherein said tab at a free end has a push-in flap (16) and in said push-in flap insertion said push-in flap terminates in two push-in slits (17) of said one wall, which slits are respectively associated with the first and second folded positions.

10. File folder according to claim 7, wherein said adjacent one of said two strips has a layer of adhesive reversibly securing said third strip thereto in said third folded position of said tab.

11. File folder according to claim 10, wherein said layer of adhesive further reversibly secures said two strips in said first folded position, and respectively reversibly secures said one of said two strips to the inside of said one wall of the file folder in said second folded position.

12. File folder according to claim 11, wherein said text tab freely projects from said border edge of said one wall of the file folder.

13. File folder according to claim 11, wherein said text tab freely projects from said border edge of said one wall of the file folder.

* * * * *